US009120321B2

(12) United States Patent
Tsujiguchi et al.

(10) Patent No.: US 9,120,321 B2
(45) Date of Patent: Sep. 1, 2015

(54) INK JET RECORDING APPARATUS AND CONTROL METHOD, CONFIGURED TO DETECT REMAINING INK

(71) Applicants: Yuuichiroh Tsujiguchi, Kanagawa (JP); Namio Ogihara, Kanagawa (JP); Hitoshi Sasaki, Kanagawa (JP)

(72) Inventors: Yuuichiroh Tsujiguchi, Kanagawa (JP); Namio Ogihara, Kanagawa (JP); Hitoshi Sasaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/245,100

(22) Filed: Apr. 4, 2014

(65) Prior Publication Data

US 2014/0313248 A1 Oct. 23, 2014

(30) Foreign Application Priority Data

Apr. 18, 2013 (JP) ..... 2013-087647

(51) Int. Cl.
*B41J 2/195* (2006.01)
*B41J 2/175* (2006.01)

(52) U.S. Cl.
CPC ..... *B41J 2/17566* (2013.01)

(58) Field of Classification Search
CPC ..... B41J 2/17566
USPC ..... 347/7, 23, 19, 57, 14, 10
See application file for complete search history.

(56) References Cited

U.S. PATENT DOCUMENTS

| | | | | |
|---|---|---|---|---|
| 6,151,039 | A * | 11/2000 | Hmelar et al. | 347/7 |
| 2002/0054182 | A1* | 5/2002 | Yazawa | 347/23 |
| 2010/0302302 | A1* | 12/2010 | Kubo | 347/19 |
| 2013/0135397 | A1* | 5/2013 | Nishimura et al. | 347/57 |
| 2013/0335471 | A1* | 12/2013 | Murase et al. | 347/14 |
| 2014/0092154 | A1* | 4/2014 | Uchino | 347/10 |

FOREIGN PATENT DOCUMENTS

| | | |
|---|---|---|
| JP | 2003-136690 | 5/2003 |
| JP | 2010-260248 | 11/2010 |
| JP | 2012-250383 | 12/2012 |

* cited by examiner

*Primary Examiner* — Julian Huffman
*Assistant Examiner* — Carlos A Martinez
(74) *Attorney, Agent, or Firm* — Cooper & Dunham LLP

(57) ABSTRACT

An ink jet recording apparatus includes: a container to store ink; a detector to detect a remaining ink amount; a liquid feeding unit to supply the ink to the container; an energy generation unit to cause the ink to be discharged; a storage unit to store correspondence information in which driving information for driving the energy generation unit is associated with each piece of time information indicating a supply time taken to supply the ink; and a setting unit to set new driving information using the correspondence information when an actual supply time is different from the supply time indicated by the time information associated with current driving information among the pieces of time information. The actual supply time indicates a time period from when the liquid feeding unit starts supplying the ink until the detector detects that the remaining ink amount is equal to or higher than a threshold.

10 Claims, 19 Drawing Sheets

| | VISCOSITY INFORMATION [μP] | TEMPERATURE INFORMATION [°C] | TIME INFORMATION [s] | DRIVING WAVEFORM PATTERN |
|---|---|---|---|---|
| LOW VISCOSITY | 0.23 | 80 | 4.83 | A-80 |
| | 0.25 | 60 | 5.12 | A-60 |
| | 0.28 | 40 | 5.32 | A-40 |
| | 0.30 | 20 | 5.58 | A-20 |
| | 0.32 | 0 | 5.74 | A-00 |
| ↑ | ⋮ | ⋮ | ⋮ | ⋮ |
| | 0.36 | 80 | 7.80 | M-80 |
| | 0.65 | 60 | 7.89 | M-60 |
| INITIAL VALUE | 1.00 | 40 | 8.20 | M-40 |
| | 1.31 | 20 | 8.44 | M-20 |
| | 1.79 | 0 | 8.63 | M-00 |
| ↓ | ⋮ | ⋮ | ⋮ | ⋮ |
| | 1.30 | 80 | 15.62 | Z-80 |
| | 1.45 | 60 | 15.44 | Z-60 |
| HIGH VISCOSITY | 1.54 | 40 | 15.20 | Z-40 |
| | 1.62 | 20 | 14.98 | Z-20 |
| | 1.69 | 0 | 14.77 | Z-00 |

| | VISCOSITY INFORMATION [μP] | TEMPERATURE INFORMATION [°C] | DISCHARGE AMOUNT INFORMATION [ml] | DRIVING WAVEFORM PATTERN |
|---|---|---|---|---|
| LOW VISCOSITY | 0.23 | 80 | 34.77 | A-80 |
| | 0.25 | 60 | 34.98 | A-60 |
| | 0.28 | 40 | 35.20 | A-40 |
| | 0.30 | 20 | 35.44 | A-20 |
| | 0.32 | 0 | 35.62 | A-00 |
| ↑ | ⋮ | ⋮ | ⋮ | ⋮ |
| | 0.36 | 80 | 28.63 | M-80 |
| | 0.65 | 60 | 28.44 | M-60 |
| INITIAL VALUE | 1.00 | 40 | 28.20 | M-40 |
| | 1.31 | 20 | 27.89 | M-20 |
| | 1.79 | 0 | 27.80 | M-00 |
| ↓ | ⋮ | ⋮ | ⋮ | ⋮ |
| | 1.30 | 80 | 25.74 | Z-80 |
| | 1.45 | 60 | 25.58 | Z-60 |
| HIGH VISCOSITY | 1.54 | 40 | 25.32 | Z-40 |
| | 1.62 | 20 | 25.12 | Z-20 |
| | 1.69 | 0 | 24.83 | Z-00 |

INK JET RECORDING APPARATUS AND CONTROL METHOD, CONFIGURED TO DETECT REMAINING INK

CROSS-REFERENCE TO RELATED APPLICATIONS

The present application claims priority to and incorporates by reference the entire contents of Japanese Patent Application No. 2013-087647 filed in Japan on Apr. 18, 2013.

BACKGROUND OF THE INVENTION

1. Field of the Invention

The present invention relates to an ink jet recording apparatus and a control method.

2. Description of the Related Art

Conventional ink jet printers are used in various industrial applications based on a characteristic that they can perform printing in a non-contact manner. In the ink jet printers, known has been a technique of detecting ink viscosity based on the temperature of an ink discharging head or the like and switching an ink discharge control manner.

For example, Japanese Patent Application Laid-open No. 2003-136690 discloses a recording head that performs recording by driving an energy generation member in accordance with a recording signal and ejecting ink droplets through a plurality of nozzle openings provided on an orifice plate. The recording head includes, as an adjusting unit for providing optimum ink droplets in accordance with ink viscosity, a unit that detects an ink temperature, a unit that controls to heat the ink, and a unit that controls a driving waveform of the energy generation member.

The conventional technique has, however, a problem that control is performed based on an ink characteristic of one type only and ink discharge control cannot be executed appropriately based on various ink characteristics.

Therefore, there is a need for an ink jet recording apparatus and a control method that are capable of executing ink discharge control appropriately based on various ink characteristics.

SUMMARY OF THE INVENTION

According to an embodiment, an ink jet recording apparatus includes a container to store therein ink; a first detector to detect a remaining amount of the ink in the container; a liquid feeding unit to supply the ink to the container; an energy generation unit to cause the ink to be discharged; a storage unit to store therein correspondence information in which driving information indicating information for driving the energy generation unit is associated with each piece of time information indicating a predetermined supply time taken to supply the ink; and a setting unit to set new driving information using the correspondence information when an actual supply time is different from the supply time indicated by the time information associated with current driving information among the pieces of time information contained in the correspondence information. The actual supply time indicates a time period from when the liquid feeding unit starts supplying the ink until the first detector detects that the remaining amount of the ink in the container is equal to or higher than a threshold.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments of an ink jet recording apparatus, a control method, and a program according to the present invention are described in detail with reference to the accompanying drawings. Although the following describes the case where the ink jet recording apparatus according to the invention is applied to an ink jet printer, as an example, the ink jet recording apparatus is not limited thereto.

First Embodiment

Figure 1:
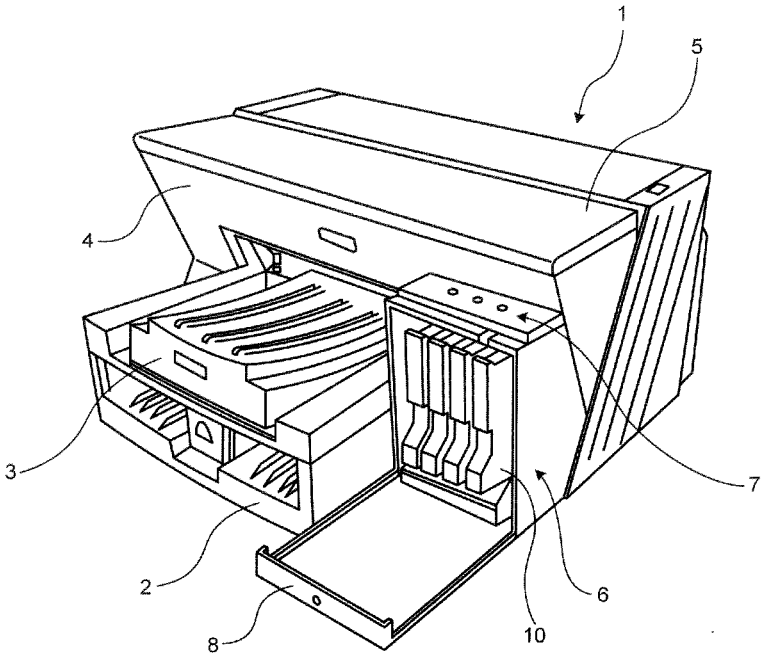
FIG. 1 is a view illustrating an example of an ink jet printer according to an embodiment.

FIG. 1 is a view illustrating an example of the ink jet printer according to a first embodiment. The ink jet printer includes an apparatus main body 1, a sheet feeding tray 2, a discharge tray 3, a cartridge loading unit 6, and an operating unit 7.

The sheet feeding tray 2 is attached to the apparatus main body 1 for loading sheet as a recording medium, and sheet on which an image has been recorded (formed) is placed on the discharge tray 3. The cartridge loading unit 6 is provided on a front surface 4 of the apparatus main body 1 at one end side so as to project to the front side from the front surface 4 and be lower than an upper surface 5.

The operating unit 7 such as an operation key and a display device is provided on the upper surface of the cartridge loading unit 6 that projects from the front surface 4. The cartridge loading unit 6 includes a front cover 8 that can be opened and closed for attaching and detaching ink cartridges 10 as liquid storage tanks (main tanks).

FIG. 1 illustrates only four ink cartridges (colorant: black, cyan, magenta, yellow) but one to four processing liquid cartridges (for the colorant inks requiring processing liquids) are attached in addition to the ink cartridges. It should be noted that the processing liquid is not needed for the color having high ejection reliability, or the like, in some cases.

Figure 2:
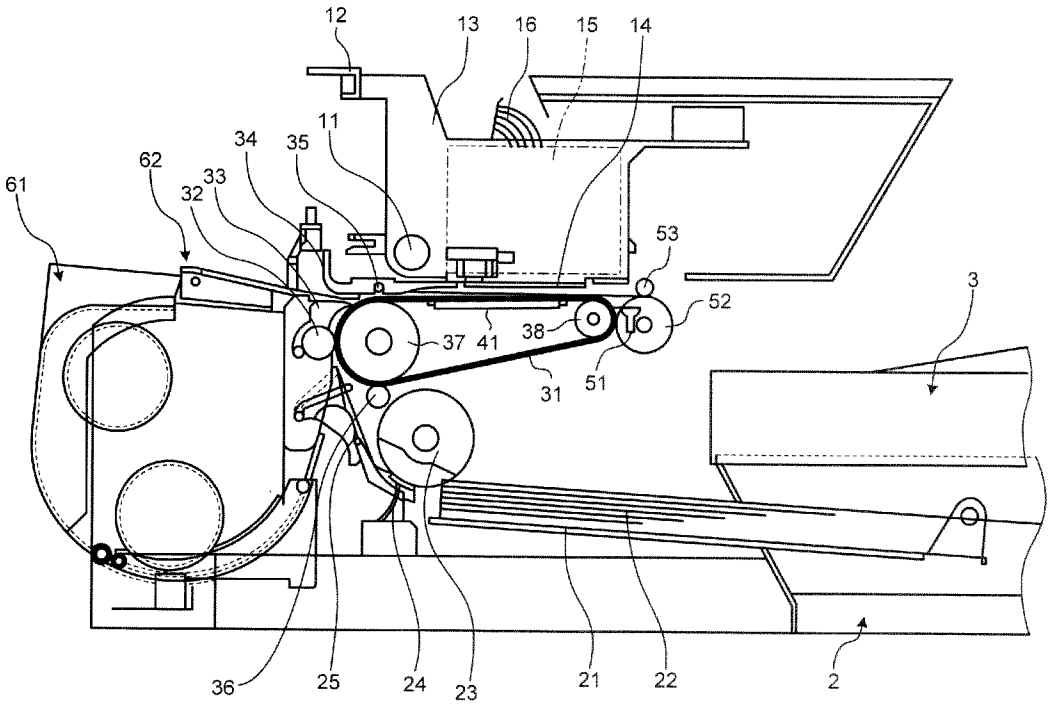
FIG. 2 is a schematic configuration view for explaining the whole configuration of a mechanical section of the ink jet printer.
Figure 3:
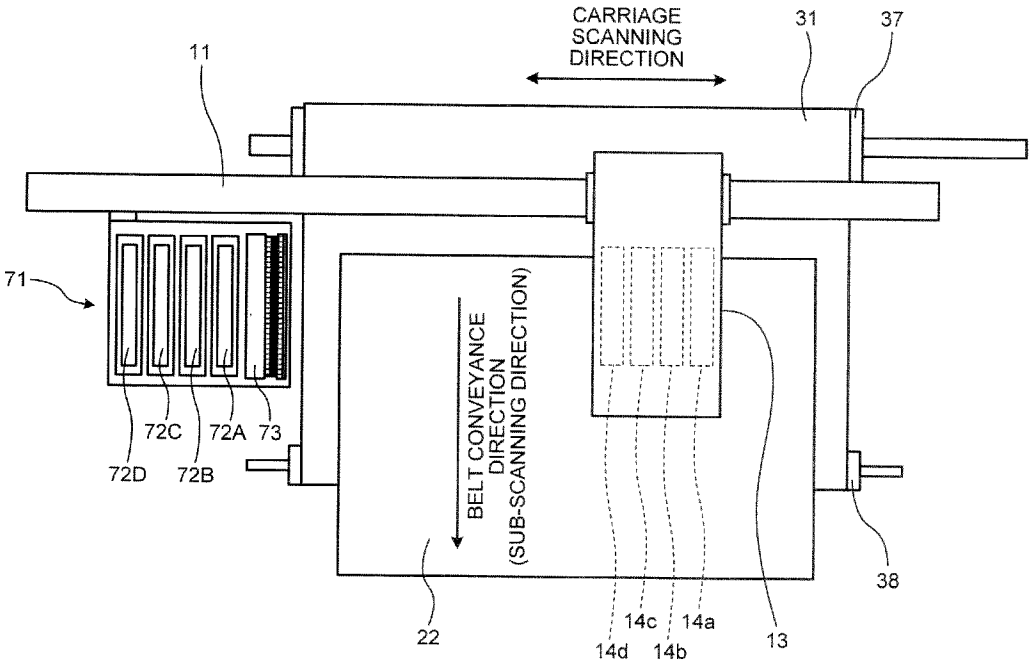
FIG. 3 is a descriptive view for explaining substantial parts of the mechanical section of the ink jet printer.

Next, a mechanical section of the ink jet printer in the embodiment is described in detail with reference to FIG. 2 and FIG. 3. FIG. 2 is a schematic configuration view for explaining the whole configuration of the mechanical section of the ink jet printer and FIG. 3 is a view for explaining substantial parts of the mechanical section of the ink jet printer. As illustrated in FIG. 2, a sheet feeding roller 23 as a semilunar roller and a separation pad 24 biased to the sheet feeding roller 23 side are provided as a sheet feeding unit for feeding sheets 22 stacked on a sheet stacking unit (pressurizing plate) 21 of the sheet feeding tray 2.

The sheet feeding roller 23 separates and feeds the sheet 22 from the sheet stacking unit 21 one by one. The separation pad 24 is made of a material having a large friction coefficient and is provided so as to be opposed to the sheet feeding roller 23. A carriage belt 31, a counter roller 32, a conveyance guide 33, and a front-end pressing roller 35 are provided as a conveying unit for conveying the sheet 22 fed from the sheet feeding unit to the lower side of a recording head 14. In addition, a charging roller 36 as a charging unit for charging the surface of the carriage belt 31 is provided.

The counter roller 32 nips the sheet 22 fed from the sheet feeding unit through a guide 25 together with the carriage belt 31 for conveyance. The conveyance guide 33 guides the sheet 22 that is fed to the upper side in substantially the vertical direction while being nipped between the counter roller 32 and the carriage belt 31 so as to turn the direction of the sheet 22 by approximately 90°. In this case, the front-end pressing roller 35 that is biased to the carriage belt 31 side by a pressing member 34 presses the sheet 22 against the carriage belt 31.

In this case, a control circuit (not illustrated) causes alternate voltage to be applied to the charging roller 36 from a high-voltage power supply such that positive output and negative output are alternately repeated. With this, the carriage belt 31 is charged in an alternating charged voltage pattern. That is, the carriage belt 31 is charged positively and negatively alternately in a form of bands each having a predetermined width in the sub-scanning direction as the revolving direction. When the sheet 22 is fed onto the carriage belt 31 charged positively and negatively alternately, the sheet 22 is electrostatically adsorbed to the carriage belt 31 so as to be conveyed in the sub-scanning direction with the revolving movement of the carriage belt 31.

The recording head 14 is driven in accordance with an image signal while a carriage 13 is moved, so that ink droplets are discharged onto the sheet 22 that stops and recording for one line is performed thereon. After the recording for one line, the sheet 22 is conveyed by a predetermined amount and recording for a subsequent line is performed on the sheet 22. Thereafter, when a recording termination signal or a signal indicating that the rear end of the sheet 22 reaches a recording region is received, a recording operation is finished. Then, the sheet 22 is discharged onto the discharge tray 3.

The carriage belt 31 is an endless belt and is wound around a carriage roller 37 and a tension roller 38 and is configured so as to revolve in the belt conveyance direction as illustrated in FIG. 3.

The charging roller 36 is arranged so as to make contact with the surface layer of the carriage belt 31 and be rotated while following the rotational movement of the carriage belt 31. A pressure force of 2.5 N is applied to both the ends of the shaft of the charging roller 36. Furthermore, a guide member 41 is arranged at the rear side of the carriage belt 31 at a position corresponding to a printing region by the recording head 14. The upper surface of the guide member 41 projects to the recording head 14 side relative to a tangent line of the two rollers (carriage roller 37 and tension roller 38) supporting the carriage belt 31. With this configuration, the carriage belt 31 is raised and guided by the upper surface of the guide member 41 on the printing region, so that planarity with high accuracy is kept.

Furthermore, a plurality of grooves are formed on the surface of the guide member 41 that makes contact with the rear surface of the carriage belt 31 in the main-scanning direction, that is, in the direction orthogonal to the conveyance direction. These grooves decrease the contact area between the carriage belt 31 and the guide member 41, so that the carriage belt 31 can be moved along the surface of the guide member 41 smoothly.

A separation claw 51, a discharging roller 52, a discharging roll 53, and the discharge tray 3 are provided as a discharging unit for discharging the sheet 22 on which the recording head 14 has performed the recording.

The separation claw 51 separates the sheet 22 from the carriage belt 31, and the discharging roller 52 and the discharging roll 53 discharge the sheet 22 onto the discharge tray 3 provided at the lower side of the discharging roller 52. The height from the position between the discharging roller 52 and the discharging roll 53 to the discharge tray 3 is set to be large at some degree in order to increase the pieces of sheet that can be placed on the discharge tray 3.

Furthermore, a double-sided sheet feeding unit 61 is attached to a rear surface portion of the apparatus main body 1 in a detachable manner. The double-sided sheet feeding unit 61 takes and reverses the sheet 22 returned with the backward rotation of the carriage belt 31 so as to feed the sheet 22 to between the counter roller 32 and the carriage belt 31, again. A manual sheet feeding unit 62 is provided on the upper surface of the double-sided sheet feeding unit 61.

As illustrated in FIG. 3, the carriage 13 is held by a guide rod 11 and a stay so as to slide in the main-scanning direction and is moved to scan in the direction as indicated by an arrow in FIG. 3 by a main-scanning motor (not illustrated). The guide rod 11 and the stay are guide members bridged between right and left side plates (not illustrated).

The recording head 14 constituted by a plurality of ink jet heads for discharging ink droplets is attached to the carriage 13 such that a plurality of nozzles are aligned in the direction intersecting with the main-scanning direction and the ink droplet discharge direction is set to the downward direction.

Furthermore, a subsystem 71 is provided on a non-printing region located at one side (may be provided at both sides) of the carriage 13 in the scanning direction. The subsystem 71 is a maintenance and recovery mechanism for maintaining and recovering the state of the nozzles of the recording head 14.

The subsystem 71 includes caps 72A, 72B, 72C, and 72D for capping the nozzle surfaces of recording heads 14*a*, 14*b*, 14*c*, and 14*d*, respectively, and a wiper blade 73 for wiping the nozzle surfaces.

The carriage 13 is moved to the subsystem 71 side and the recording heads 14*a*, 14*b*, 14*c*, and 14*d* are capped with the caps 72A, 72B, 72C, and 72D, respectively, in a printing (recording) standby state. This can keep the nozzles to be in a moisture state so as to prevent discharge failure due to dried ink. Furthermore, a recovery operation of discharging ink that is not involved in recording is performed before or during the recording so as to keep stable discharge performance.

Figure 4:
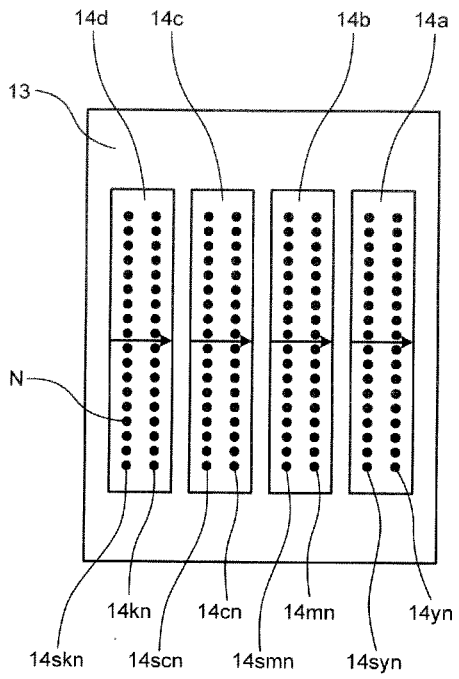
FIG. 4 is a view illustrating an example of the configuration of recording heads.

FIG. 4 is a view illustrating an example of the configuration of the recording heads 14*a*, 14*b*, 14*c*, and 14*d*. The recording head 14*a*, 14*b*, 14*c*, and 14*d* includes four heads of a yellow recording head 14*a* for discharging yellow liquid droplets, a magenta recording head 14*b* for discharging magenta liquid droplets, a cyan recording head 14*c* for discharging cyan liquid droplets, and a black recording head 14*d* for discharging recording head 14*a* includes a nozzle row 14*yn* formed by a large number of nozzles N for discharging yellow ink droplets and a nozzle row 14*syn* formed by a large number of nozzles N for discharging ink droplets of processing liquid. The magenta recording head 14*b* includes a nozzle row 14*mn* for magenta ink and a nozzle row 14*smn* for processing liquid in the same manner. The cyan recording head 14*c* also includes a nozzle row 14*cn* for cyan ink and a nozzle row 14*scn* for processing liquid. The black recording head 14*d* also includes a nozzle row 14*kn* for black ink and a nozzle row 14*skn* for processing liquid.

Each of the recording heads (14*a*, 14*b*, 14*c*, and 14*d*) can include, as an energy generation unit, piezoelectric actuators such as piezoelectric elements, thermal actuators utilizing phase transition resulting from film boiling of liquid caused by using an electric-heat converter such as a heat generation resistor, shape memory alloy actuators utilizing metal phase transition resulting from change in temperature, electrostatic actuators utilizing electrostatic force, or the like. The ink jet heads (recording heads) in which the piezoelectric actuators (piezoelectric elements) are used as the energy generation unit are mounted on the recording heads 14*a*, 14*b*, 14*c*, and 14*d* in the embodiment.

Figure 5:
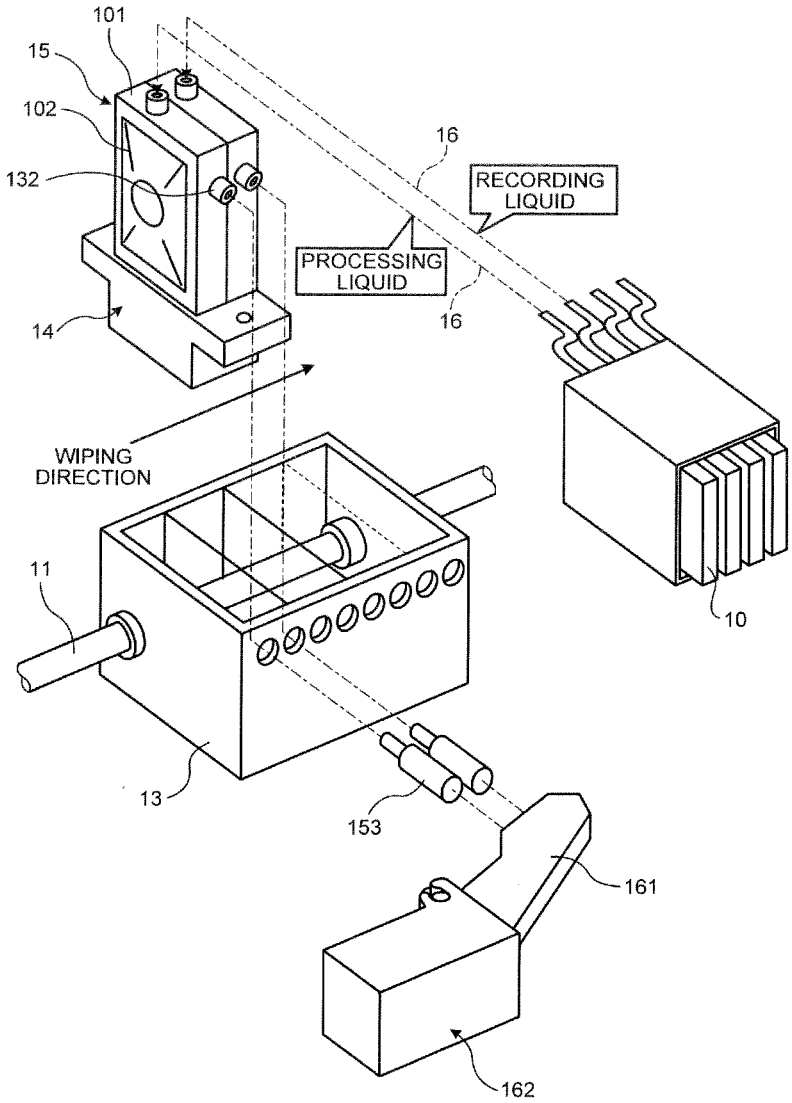
FIG. 5 is an exploded perspective view for explaining parts relating to an ink supply device.
Figure 6:
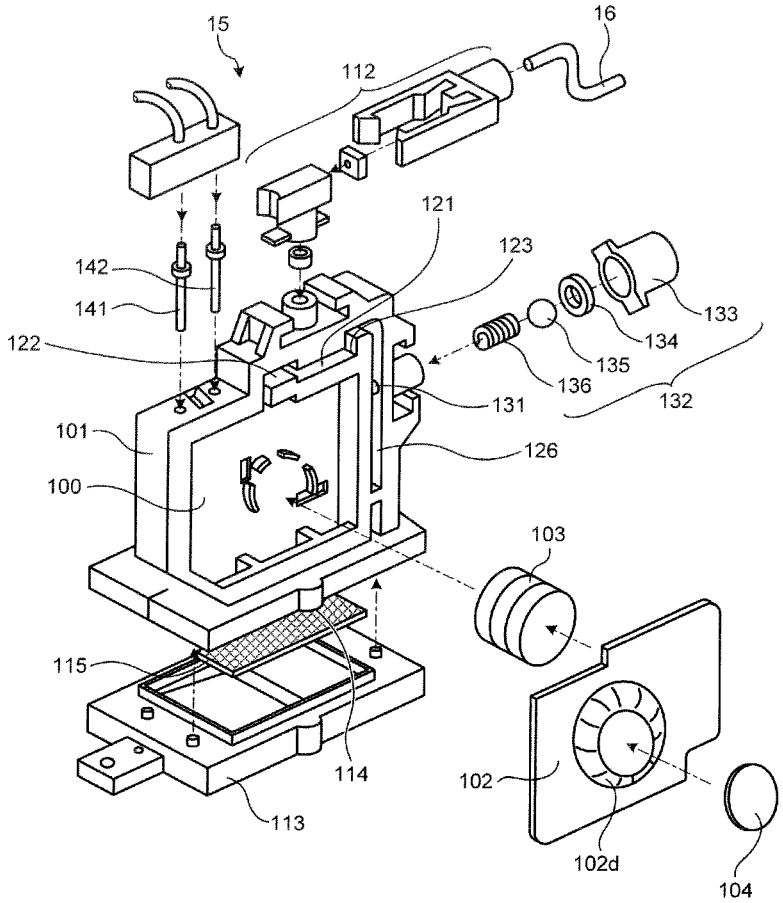
FIG. 6 is an exploded perspective view for explaining a sub tank.
Figure 7:
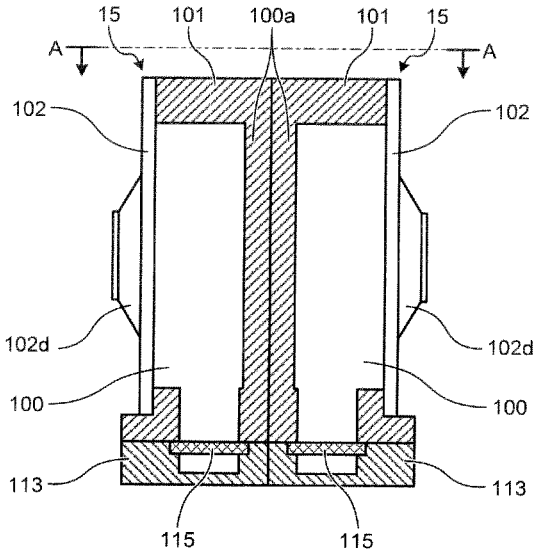
FIG. 7 is a schematic side view for explaining the sub tanks.
Figure 8A:
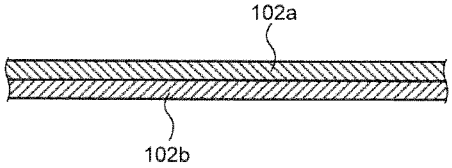
FIGS. 8A and 8B are schematic cross-sectional views along section line I-I in FIG. 7.
Figure 8B:
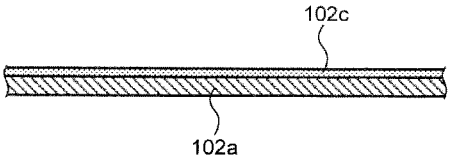

Next, an ink supply device as a liquid supply device of the ink jet printer in the embodiment is described in detail with reference to FIG. 5 to FIG. 8B. FIG. 5 is an exploded perspective view for explaining parts relating to the ink supply device. FIG. 6 is an exploded perspective view for explaining a sub tank (although only one sub tank is illustrated in FIG. 6, another sub tank is superimposed on the rear surface). FIG. 7 is a schematic side view for explaining the sub tanks. FIGS. 8A and 8B are schematic cross-sectional views along section line I-I in FIG. 7.

As illustrated in FIG. 5, sub tanks 15 are mounted on the carriage 13. The sub tanks 15 are liquid containers for the respective colors for supplying inks of the respective colors to the respective nozzle rows of the recording head 14. Although the sub tank 15 corresponds to a "container" in the appended claims, the "container" is not limited thereto.

The inks are supplemented and supplied to the sub tanks 15 from the above-mentioned main tanks 10 for the respective colors through ink supply tubes 16. The main tanks 10 are eight cartridges (four for the recording liquids, four for the processing liquids) (only four cartridges are illustrated in FIG. 5) in total that house the inks of the respective colors of yellow (Y), cyan (C), magenta (M) and black (Bk) and the processing liquids for the respective colors so as to correspond to the respective colors.

That is to say, the colorant inks and the processing liquids are supplied to the right and left sub tanks 15 and the sub tanks 15 for the colorant inks and the processing liquids are mounted on the same head face. The carriage 13 includes the necessary number of heads provided with the sub tanks housing the processing liquids and the colorant inks on the same head face for the colors.

As illustrated in FIG. 6, in each sub tank 15, a film-like member (flexible film-like member) 102 is bonded to a container main body (case main body) 101 forming an ink housing unit 100 for housing ink by adhesion, welding, or the like. The film-like member 102 seals an opening (one surface of the sub tank 15) of the ink housing unit 100 and has flexibility.

Furthermore, the ink housing unit 100 includes therein a spring 103 between the case main body 101 and the film-like member 102. The spring 103 is an elastic member for biasing the film-like member 102 to the outer side.

A bulging part 102*d* having a projecting shape corresponding to the elastic member 103 is formed on the film-like member 102 and a reinforcing member 104 is bonded to the outer surface thereof. The projecting part is provided on the flexible film-like member 102 so as to hold the elastic member 103 (spring in the embodiment) stably. In this case, the flexible film-like member 102 is produced by shaping a sheet-like film member into the projecting shape so as to form the projecting part easily.

The film-like member 102 may have a single-layer structure. Alternatively, the film-like member 102 may have a double-layer structure in which a first layer 102*a* and a second layer 102*b* of different types are laminated, as illustrated in FIG. 8A. For example, the film-like member 102 may have a double-layer structure in which a film-like member made of polyethylene and a film-like member made of nylon are laminated. Furthermore, the film-like member 102 may have a structure in which a silica-deposited layer 102*c* is formed on the first layer 102*a* as illustrated in FIG. 8B.

The film-like member 102 having a structure formed by equal to or more than two layers of different types can improve liquid resistance to the housed ink. In this case, the film-like member 102 having the laminated structure of polyethylene and nylon can ensure the liquid resistance to the ink reliably. The film-like member 102 including the silica-deposited layer can also improve the liquid resistance to the housed ink.

The thickness of the film-like member 102 is preferably 10 to 100 μm. When the thickness of the film-like member 102 is smaller than 10 μm, damage or the like due to time degradation is easy to be generated. When the thickness of the film-like member 102 is larger than 100 μm, flexibility is lowered, resulting in a risk that efficient generation of the negative pressure becomes difficult.

The case main body 101 is provided with an ink inlet path unit 111 for replenishing the ink in the ink housing unit 100. A connecting unit 112 for connecting the ink inlet path unit 111 and the ink supply tube 16 connected to the ink cartridge 10 is attached in a detachable manner. A liquid feeding pump (liquid feeding unit), which will be described later, is provided between the ink cartridge 10 and the sub tank 15 in order to feed the ink to the sub tank 15 from the ink cartridge 10 in a pressurized manner.

A connecting member 113 for supplying the ink to the recording head 14 from the ink housing unit 100 is attached to a lower portion of the case main body 101. An ink supply path 114 of the recording head 14 is formed on the connecting member 113 and a filter 115 is interposed between the connecting member 113 and the ink housing unit 100.

An air flow path 121 for releasing the air from the ink housing unit 100 is formed on an upper portion of the case main body 101. The air flow path 121 includes an entrance flow path part 122 of which opening faces the ink housing unit 100 and a flow path part (referred to as "orthogonal flow path part") 123 continuous to the entrance flow path part 122. The air flow path 121 communicates with an air releasing hole 131 provided on the case main body 101 at the downstream side. An accumulation unit 126 is continuously formed on the air flow path 121 at the further lower side relative to the air releasing hole 131 in a used state.

The air releasing hole 131 is provided with an air releasing valve mechanism 132 as an air releasing unit for switching the inner portion of the sub tank 15 between a sealed state and an air releasing state. The air releasing valve mechanism 132 is configured by putting a valve seat 134, a ball 135 as a valve body, and a spring 136 biasing the ball 135 to the valve seat 134 side in a holder 133.

An action of the accumulation unit 126 is described in detail. When the apparatus main body is inclined or swung, it is highly likely that the ink enters the air flow path 121. For coping with this, the ink entered through the air flow path 121 can be made to be accumulated in the accumulation unit 126. This prevents a problem that the ink enters the air releasing hole 131 and the air releasing valve mechanism 132 for opening and closing the air releasing hole 131 to be solidified and an operation failure of the air releasing valve mechanism 132 occurs even if the apparatus main body is made to drop and so on when transported and the ink enters the air flow path 121.

Two detecting electrodes 141 and 142 are attached to an upper portion of the case main body 101. The two detecting electrodes 141 and 142 detect that an ink amount in the sub tank 15 is equal to or smaller than a predetermined amount (this state is defined as "ink absent state"). The ink absent state can be determined by detecting a state where both the detecting electrodes 141 and 142 dip in the ink and a state where at least one of them does not dip in the ink based on change in the conducting state between the detecting electrodes 141 and 142.

Furthermore, an air releasing pin 153 for pressurizing the ball 135 of the air releasing valve mechanism 132 against the spring 136 to release the air in each sub tank 15 is arranged so as to advance and retreat. As illustrated in FIG. 5, a driving unit 162 including a lever 161 for operating the air releasing pins 153 is arranged on the apparatus main body.

In the embodiment, the two sub tanks 15 are arranged for one recording head 14 as illustrated in FIG. 7, so that the two sub tanks 15 are integrated by bonding the rear surfaces of the two sub tanks 15. In this case, one of the sub tanks is for the recording liquid and the other thereof is for the processing liquid. Partition wall parts 100*a* between the two ink housing units 100 can be also shared. The processing liquid may be low-pigment-concentration recording liquid having the reduced colorant concentration of the recording liquid.

Ink supply operation of the ink supply device configured as described above is described. For example, when it is detected that the ink amount in each sub tank 15 is equal to or lower than a lower limit threshold, the ink supply operation can be started, whereas when it is detected that the ink amount in each sub tank 15 is equal to or higher than an upper limit threshold, the ink supply operation can be stopped. First, the driving unit 162 operates the air releasing pin 153 so as to make the air releasing valve mechanism 132 of each sub tank 15 into the opened state. This makes the inner portion of the sub tank 15 into the air releasing state. Then, ink is fed to the sub tank 15 from the ink cartridge 10 by the liquid feeding pump so as to be replenished and supplied thereto. In this case, the air in the sub tank 15 is discharged through the air releasing valve mechanism 132. The biasing force by the spring 103 is applied to the flexible film-like member 102, so that a negative pressure is generated in the sub tank 15.

The flexible film-like member and the elastic member can generate the negative pressure in each sub tank in this manner. This can configure a negative pressure generation mechanism easily.

Figure 9:
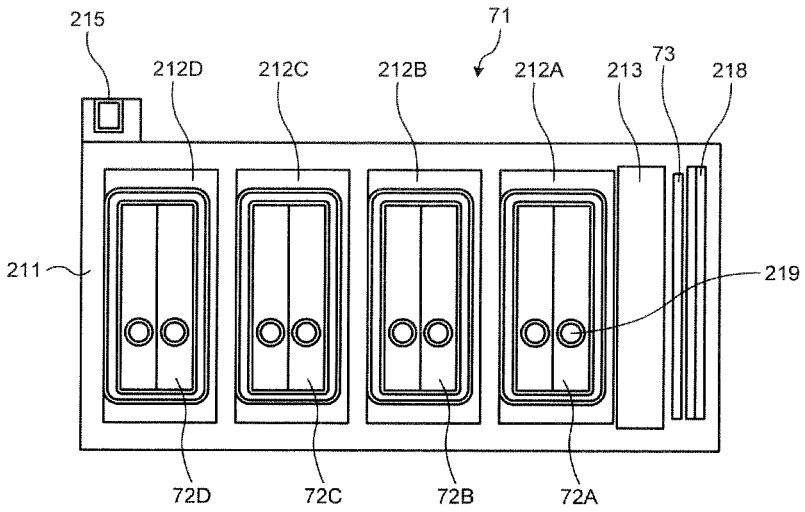
FIG. 9 is a plan view for explaining a subsystem.

Next, the configuration of the subsystem 71 is described in detail with reference to FIG. 9 and FIG. 10. FIG. 9 is a plan view for explaining the subsystem and FIG. 10 is a schematic view illustrating the schematic configuration of the subsystem (caps 72C and 72D are not illustrated).

As illustrated in FIG. 9, a frame 211 holds four cap holders 212A, 212B, 212C, and 212D (hereinafter, referred to as "cap holder 212" collectively), an idling discharge receiver 213, the wiper blade 73, and a carriage lock 215 such that the respective components can be moved up and down. The wiper blade 73 is a wiping member including an elastic body as a cleaning unit.

The cap holders 212A, 2120, 212C, and 212D hold the caps 72A, 72B, 72C, and 72D (that are referred to as "cap 72", hereinafter) for capping the nozzle surfaces of the liquid droplet discharging heads 14*a*, 14*b*, 14*c*, and 14*d*, respectively.

Figure 10:
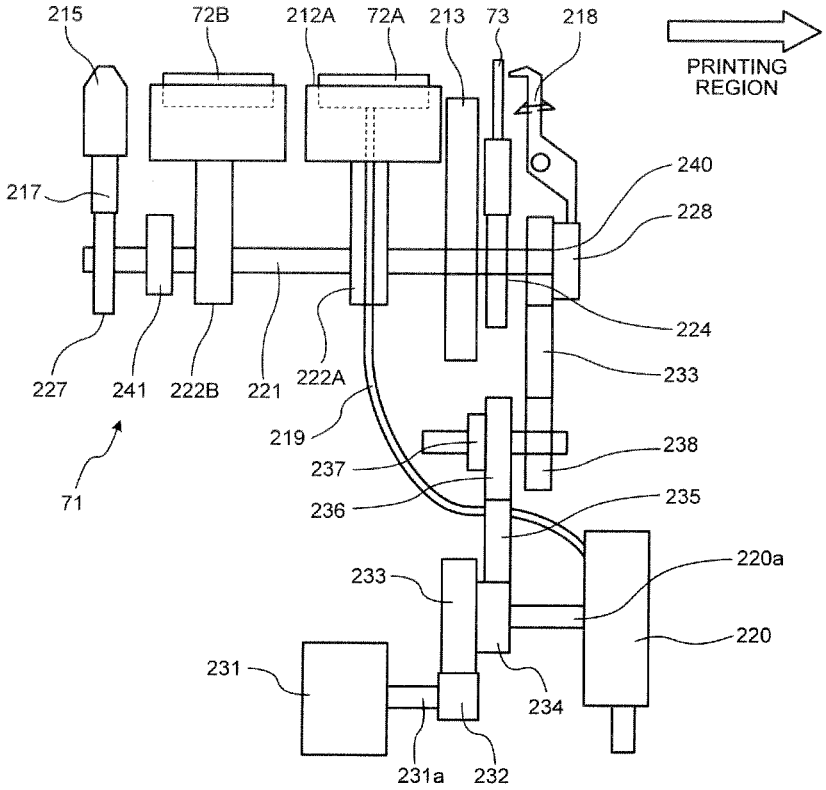
FIG. 10 is a schematic view illustrating the schematic configuration of the subsystem.

As illustrated in FIG. 10, a tube pump 220 (suction pump) as a suction unit is connected to the cap 72A held on the cap holder 212A that is the closest to the printing region through a tube 219. On the other hand, the tube pump 220 is not connected to the other caps 72B, 72C, and 72D. That is to say, only the cap 72A is a cap for recovery and moisturizing and the other caps 72B, 72C, and 72D are caps for moisturizing simply.

Accordingly, when the recovery operation of the recording head 14 or the ink supply operation to each sub tank 15 is performed, the recording head 14 is selectively moved to a position at which it can be capped with the cap 72A. A cam shaft 221 is arranged at the lower side of the cap holders 212A, 212B, 212C, and 212D in a rotatable manner.

The cam shaft 221 is provided with cap cams 222A, 222B, 222C, and 222D for moving up and down the cap holders 212A, 212B, 212C, and 212D, respectively, a wiper cam 224 for moving up and down the wiper blade 73, and a carriage lock cam 227 for moving up and down the carriage lock 215 through a carriage lock arm 217.

A wiper cleaner 218 for cleaning the wiper blade 73 is arranged at the printing region side of the wiper blade 73. The wiper cleaner 218 can swing in the direction as indicated by an arrow and is biased in the direction of being separated from the wiper blade 73 by a spring (not illustrated). A wiper cleaner cam 228 for causing the wiper cleaner 218 to swing is provided on the cam shaft 221. The caps 72 are moved up and down by the cap cams 222A, 222B, 222C, and 222D.

The wiper blade 73 is moved up and down by the wiper cam 224. When the wiper blade 73 is moved down, the wiper cleaner 218 advances. With this, the wiper blade 73 is moved down while being sandwiched between the wiper cleaner 218 and the idling discharge receiver 213, so that the ink attached to the wiper blade 73 is scraped off on the idling discharge receiver 213. A scraping mechanism for scraping off the ink on the idling discharge receiver is further provided because the ink is solidified on the idling discharge receiving part in some cases. To be specific, the scraping mechanism has a wiper structure that scrapes off the ink in one direction and the ink is scraped off smoothly if the processing liquid is printed on the part.

The carriage lock 215 is biased upward (in the lock direction) by a compression spring (not illustrated) and is moved up and down by the carriage lock arm 217. In order to drive the tube pump 220 and the cam shaft 221 rotationally, rotation of a motor 231 is transmitted with the following configuration. That is, a pump gear 233 provided on a pump shaft 220*a* of the tube pump 220 is engaged with a motor gear 232 provided on a motor shaft 231*a*. Furthermore, an intermediate gear 236 equipped with a one-way clutch 237 is engaged with an intermediate gear 234 integrated with the pump gear 233 through an intermediate gear 235. Moreover, a cam gear 240 fixed to the cam shaft 221 is engaged faith an intermediate gear 238 arranged coaxially with the intermediate gear 236 through an intermediate gear 239.

The cam shaft 221 is provided with a home position sensor cam 241 for detecting a home position. The home position sensor cam 241 operates a home position lever (not illustrated) when a home position sensor (not illustrated) provided on the subsystem 71 detects that the cap 72 reaches the lower-most end. With this, the sensor is made into an opened state to thereby detect the home position of the motor 231 (components other than the tube pump 220).

When the power supply is turned ON, the home position sensor is moved up and down regardless of the position of the cap 72 (cap holder 212). The home position sensor does not perform position detection until it starts moving, and it is moved by a predetermined amount to the lower-most end after detecting the home position of the cap 72 (during upward movement). Thereafter, the carriage is moved sideways to be returned to the cap position after the position detection, and the recording head 14 is capped.

In the subsystem 71, when the motor 231 rotates forward, the motor gear 232, the pump gear 233, the intermediate gear 234, and the intermediate gears 235 and 236 rotate. When the pump shaft 220*a* of the tube pump 220 rotates, the tube pump 220 is operated so as to suck the inner portion of the cap 72A for recovery and moisturizing. The other gears subsequent to the gear 238 are not rotated (operated) because the rotation is shut off by the one-way clutch 237.

When the motor 231 is rotated backward, the one-way clutch 237 is connected, so that the rotation of the motor 231 is transmitted to the cam gear 240 through the motor gear 232, the pump gear 233, the intermediate gear 234, and the intermediate gears 235, 236, 238, and 239. With this, the cam shaft 221 is rotated. In this case, the tube pump 220 does not rotate with the backward rotation of the pump shaft 220*a*.

Figure 11:
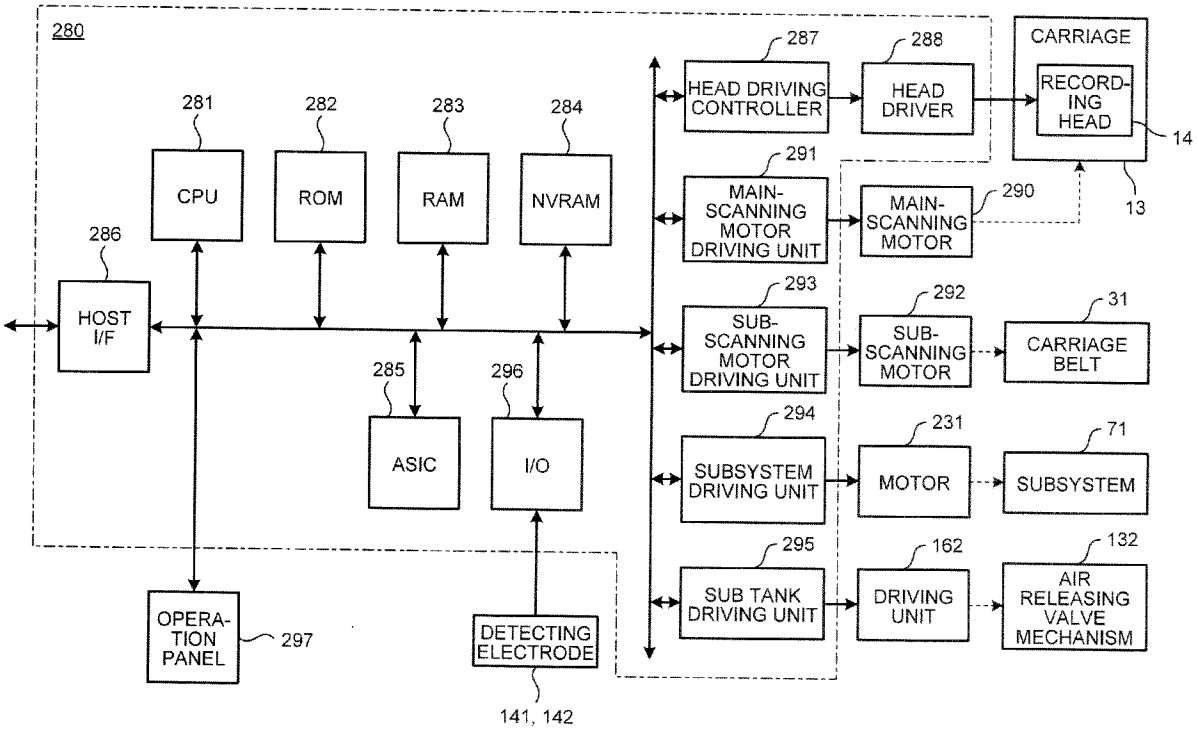
FIG. 11 is a diagram illustrating an example of the configuration of a controller.

Next, outline of a controller for comprehensively controlling operations of the whole ink jet printer in the embodiment is described in detail with reference to FIG. 11. A controller 280 includes a central processing unit (CPU) 281, a read only memory (ROM) 282, a random access memory (RAM) 283, a non-volatile memory (NVRAM) 284, and an application-specific integrated circuit (ASIC) 285.

The CPU 281 controls the whole ink jet printer and the ROM 282 stores therein programs that are executed by the CPU 281 and other pieces of fixed data. Furthermore, the RAM 283 is used for temporarily storing image data and the like and the non-volatile memory (NVRAM) 284 also holds data while the power supply of the apparatus is shut off. The ASIC 285 performs various pieces of signal processing on image data, image processing of performing sorting or the like, and processing on input and output signals for controlling other devices overall.

The controller 280 includes a host interface (I/F) 286, a head driving controller 287, a head driver 288, a main-scanning motor driving unit 291, a sub-scanning motor driving unit 293, a subsystem driving unit 294, a sub tank driving unit 295, and an I/O 296.

The host I/F 286 transmits and receives data and signals to and from the host side. The head driving controller 287 and the head driver 288 control driving of the recording head 14. The main-scanning motor driving unit 291 controls driving of a main-scanning motor 290, the sub-scanning motor driving unit 293 controls driving of a sub-scanning motor 292, the subsystem driving unit 294 controls driving of the motor 231 of the subsystem 71, and the sub tank driving unit 295 controls driving of the driving unit 162 for releasing the air in the sub tanks 15.

Furthermore, the I/O 296 inputs detection signals from the detecting electrodes 141 and 142 of the sub tanks 15 and detection signals from various sensors (not illustrated). In the embodiment, a temperature sensor (not illustrated) for detecting the temperature in the recording head 14 is provided and the I/O 296 also inputs a detection signal from the temperature sensor. The CPU 281 detects the temperature in the recording head 14 based on the detection signal from the temperature sensor (not illustrated).

An operation panel 297 for inputting and displaying information necessary for the apparatus is connected to the controller 280.

The following describes operations of the controller 280 when the ink jet printer in the embodiment forms an image. The controller 280 receives print data and the like from an information processing apparatus such as a personal computer, an image reading apparatus such as an image scanner, or an image capturing apparatus such as a digital camera at the host side through a cable or a network by the host I/F 286. The CPU 281 reads and analyzes the print data in a receiving buffer included in the host I/F 286, performs necessary image processing, data sorting operation, and the like, on the ASIC 285, and transfers image data to the head driving controller 287.

A dot pattern data for outputting an image may be created by storing font data in the ROM 282, or converting the image data to bit map data by a printer driver at the host side and transferring it to the apparatus, for example.

When the head driving controller 287 receives the image data (dot pattern data) for one line of the recording head 14, it transmits the dot pattern data for one line as serial data to the head driver 289 in synchronization with a clock signal, and transmits a latch signal to the head driver 288 at a predetermined timing.

The head driving controller 287 includes a ROM (that may be the ROM 282), a waveform creation circuit, and a driving waveform generation circuit including an amplifier. The ROM stores therein pattern data of a driving waveform indicating the waveform of a driving signal (electric signal) for driving the piezoelectric actuators (an example of an energy generation unit) that convert electric power to pressure. The waveform generation circuit includes a digital-to-analog (D/A) converter that D/A-converts data of the driving waveform read from the ROM.

The head driver 288 includes a shift register, a latch circuit, a level shift circuit (level shifter), and an analog switch array (switching unit). The shift register receives the clock signal and the serial data as the image data from the had driving controller 287. The latch circuit latches a registration value of the shift register with the latch signal from the head driving controller 287. The level shift circuit (level shifter) shifts the level of the output value of the latch circuit. The analog switch array (switching unit) is controlled to be turned ON/OFF by the level shifter. The head driver 288 controls to turn the analog switch array ON/OFF so as to selectively apply the desired driving waveform contained in the driving waveforms to the piezoelectric actuators of the recording head 14 and drive the head under control of the CPU 281. This causes ink droplets to be discharged. A method of selecting the driving waveform will be described later.

The CPU 281 loads the detection signals from the detecting electrodes 141 and 142 through the I/O 296 and detects whether the remaining amount of the ink in each sub tank 15 is equal to or lower than a lower limit threshold (whether ink in the sub tank 15 is absent). This configures a liquid amount detecting sensor.

Figure 12:
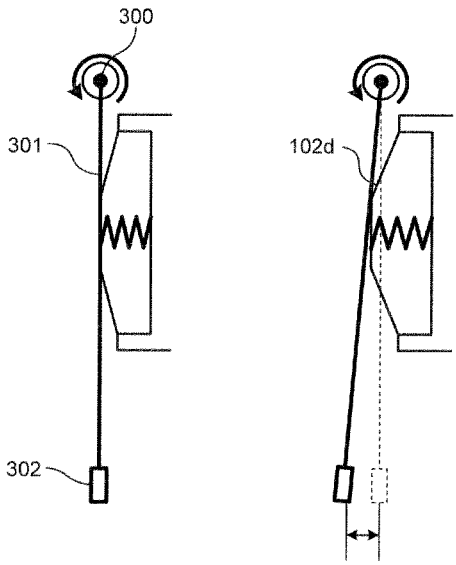
FIG. 12 is a view illustrating a detecting method by an ink full-state detecting filler installed on the sub tank.

Next, a method of detecting the ink remaining amount in each sub tank 15 is described in detail with reference to FIG. 12 FIG. 12 is a view illustrating the detecting method by an ink full-state detecting filler installed on each sub tank 15. As illustrated in FIG. 12, an ink full-state detecting filler 301 is installed on the sub tank 15 so as to be rotatable about an ink full-state detecting filler fulcrum 300 and be pressed by the bulging part 102*d* with a rotation spring in a contact manner. In this case, when ink in the sub tank 15 is increased or decreased, the pressure contact part is pressed by the bulging part 102*d* and an ink full-state detecting filler front end 302 is moved in the main-scanning direction. Accordingly, the ink remaining amount in the sub tank 15 can be detected by reading the position of the ink full-state detecting filler front end 302.

Figure 13:
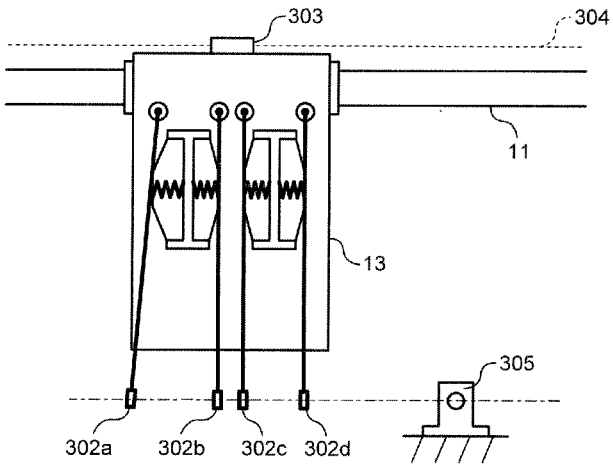
FIG. 13 is a configuration view illustrating a filler detecting sensor.

FIG. 13 is a configuration view illustrating a filler detecting sensor installed on the apparatus main body. The sub tanks 15 are mounted on the carriage 13 and a filler detecting sensor 305 as a transmission-type optical sensor is installed such that ink full-state detecting filler front ends 302*a*, 302*b*, 302*c*, and 302*d* pass through the filler detecting sensor 305 when the carriage 13 is moved in the main-scanning direction. An encoder sensor 303 reads an encoder scale 304 so as to detect the position of the carriage 13 in the main-scanning direction. The ink remaining amounts in the sub tanks 15 can be detected based on the main-scanning positions when the filler detecting sensor 305 detects the ink full-state detecting filler front ends 302*a*, 302*b*, 302*c*, and 302*d*.

In the embodiment, the I/O 296 also inputs a detection signal from the filler detecting sensor 305 and the CPU 281 detects whether the ink remaining amounts in the sub tanks 15 are equal to or higher than the upper limit threshold (whether the sub tanks 15 are in the full state) based on the detection signal from the filler detecting sensor 305.

Figure 14:
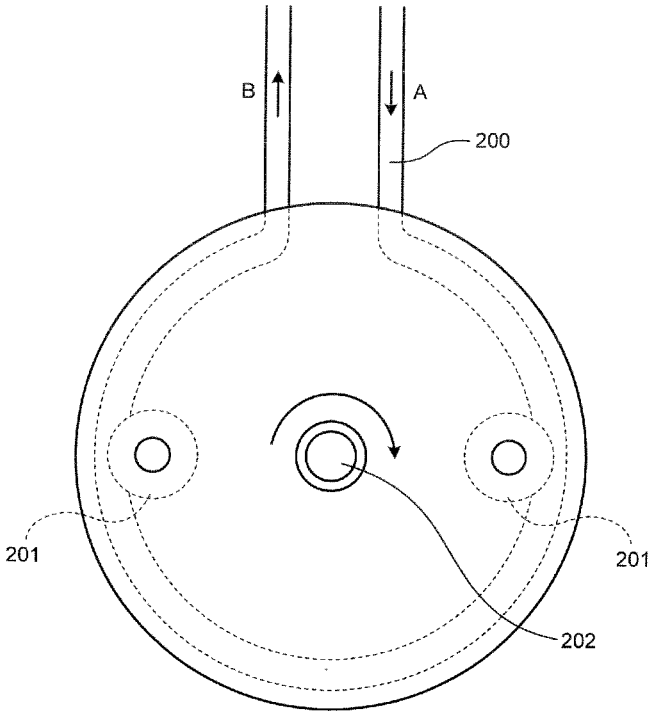
FIG. 14 is a view for explaining a supply pump unit.

The following describes a supply pump unit (tubing pump, corresponding to "liquid feeding unit") that supplies ink to the sub tanks 15. As illustrated in FIG. 14, the outer circumference of a tube 200 abuts against the tubing pump. The tube 200 is arranged on the cylindrical inner surface of a case (not illustrated) having a predetermined inner diameter in a substantially ring form. Pressure contact rollers 201 provided at the center side of the case compress the tube 200 by a certain amount. When the pressure contact rollers 201 rotate in the clockwise direction in FIG. 14 about a shaft 202 connected to a rotating motor, the ink is sucked from the A direction to be fed in the B direction. In this case, a liquid feeding amount per unit time can be changed in accordance with the compressed amount of the tube 200. The shaft 202 connected to the rotating motor is rotated with rotating force of the motor by specifying a feeding amount (ml/s) of the ink. The ink amount that is fed actually varies in accordance with the viscosity of the ink. The controller 280 controls to drive and stop the tubing pump.

Figures 15, 16:
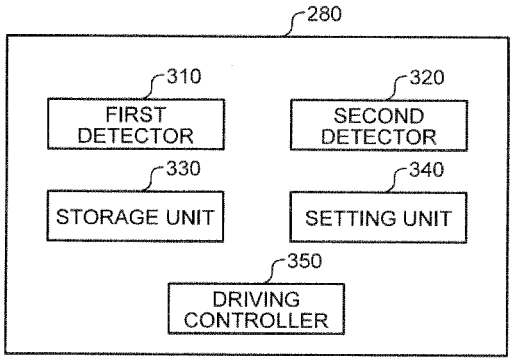
FIG. 15 is a block diagram illustrating an example of the functional configuration of the controller according to a first embodiment of the present invention.
FIG. 16 is a table illustrating an example of correspondence information in the first embodiment.

Next, a method of selecting the driving waveform in the embodiment is described. FIG. 15 is a block diagram illustrating an example of functions relating to selection of the driving waveform among the functions of the controller 280 in the embodiment. As illustrated in FIG. 15, the controller 280 includes a first detector 310, a second detector 320, a storage unit 330, a setting unit 340, and a driving controller 350.

The first detector 310 has a function of detecting the ink remaining amount in each sub tank 15. To be more specific, the first detector 310 has a function of detecting whether the ink remaining amount in each sub tank 15 is equal to or lower than the lower limit threshold (whether it is in the ink absent state) based on the detection signals from the detecting electrodes 141 and 142. Furthermore, the first detector 310 has a function of detecting whether the ink remaining amount in each sub tank 15 is equal to or higher than the upper limit threshold (whether it is in the ink full state) based on the detection signal from the filler detecting sensor 305.

The second detector 320 has a function of detecting the temperature in the recording head 14. To be more specific, the second detector 320 has a function of detecting the temperature in the recording head 14 based on the detection signal from the temperature sensor (not illustrated).

The storage unit 330 stores therein correspondence information in which a driving waveform pattern indicating the driving waveform for driving the piezoelectric actuators and temperature information indicating the predetermined temperature in the recording head 14 are associated with each piece of time information indicating a predetermined supply time taken to supply the ink. Although the driving waveform pattern in this embodiment corresponds to "driving information" in the appended claims, the driving information is not limited thereto. FIG. 16 is a table schematically illustrating an example of the correspondence information. In the example of FIG. 16, the correspondence information is information in which the driving waveform pattern, the temperature information, and viscosity information indicating the ink viscosity are associated with each piece of time information.

Description is continued with reference to FIG. 15 again. The setting unit 340 has a function of setting a new driving waveform pattern using the above-mentioned correspondence information when an actual supply time is different from the supply time indicated by the time information associated with the current driving waveform pattern among the pieces of time information contained in the correspondence information stored in the storage unit 330. The actual supply time indicates the time period from when the liquid feeding unit starts ink supply until the first detector 310 detects that the ink remaining amount in each sub tank 15 is equal to or higher than the upper limit threshold. To be more specific, when the actual supply time is different from the supply time indicated by the time information associated with the current driving waveform pattern among the pieces of time information contained in the correspondence information, the setting unit 340 sets, as the new driving waveform pattern, a driving waveform pattern associated with the time information corresponding to the actual supply time among the driving waveform patterns contained in the correspondence information. To be further more specific, when the actual supply time is different from the supply time indicated by the time information associated with the current driving waveform pattern among the pieces of time information contained in the correspondence information, the setting unit 340 sets, as the new driving waveform pattern, a driving waveform pattern associated with the time information corresponding to (in the embodiment, identical to) the actual supply time and the temperature information corresponding to (in the embodiment, identical to) the temperature detected by the second detector 320 among the driving waveform patterns contained in the correspondence information.

The driving controller 350 controls to drive the piezoelectric actuators (an example of the energy generation unit) based on the driving waveform pattern set by the setting unit 340.

The CPU 281 executes programs stored in the storage device such as the ROM 282 so as to implement the functions of the respective parts (the first detector 310, the second detector 320, the setting unit 340, and the driving controller 350) of the above-mentioned controller 280. Note that the functions of the respective parts are not limited to be implemented in the above-mentioned manner, and a hardware circuit (semiconductor integrated circuit or the like) may implement at least a part of the functions of the respective parts of the above-mentioned controller 280. The above-mentioned storage unit 330 can be implemented by a storage device such as the ROM 282 and the NVRAM 284.

Figure 17:
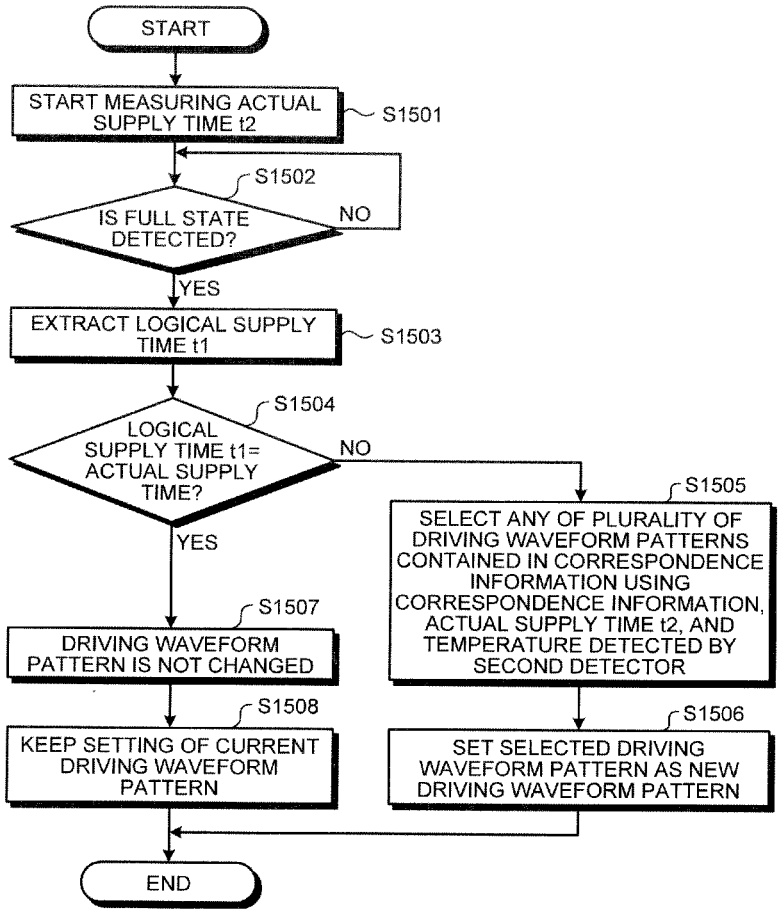
FIG. 17 is a flowchart illustrating an example of procedures of setting a driving waveform pattern at the time of ink supply operation.

FIG. 17 is a flowchart illustrating an example of procedures of setting the driving waveform pattern at the time of the ink supply operation. The driving waveform pattern at the start time of the ink supply operation is assumed to be set to the previously selected driving waveform pattern. In an initial state where any driving waveform pattern is not yet selected, a driving waveform pattern (default driving waveform pattern) indicating an initial value is set.

First, the controller 280 controls to start measuring an actual supply time t2 (step S1501). Subsequently, the first detector 310 detects whether the ink remaining amount in each sub tank 15 is equal to or higher than the upper limit threshold (whether the sub tank 15 is in the full state) based on the detection signals from the detecting electrodes 141 and 142 (step S1502). If the first detector 310 detects that the ink remaining amount in the sub tank 15 is equal to or higher than the upper limit threshold (Yes at step S1502), the setting unit 340 extracts a logical supply time t1 indicating the time information associated with the current driving waveform pattern among the pieces of time information contained in the correspondence information stored in the storage unit 330 (step S1503). At this time, the controller 280 controls to finish measuring the actual supply time t2 (actual supply time t2 is settled).

Then, the setting unit 340 compares the logical supply time t1 extracted at step S1503 and the actual supply time t2 and determines whether the logical supply time t1 and the actual supply time t2 are identical (step S1504). If the setting unit 340 determines that the logical supply time t1 and the actual supply time t2 are not identical (No at step S1504), the setting unit 340 selects any one of the driving waveform patterns contained in the correspondence information using the correspondence information stored in the storage unit 330, the actual supply time t2, and the temperature (temperature in the recording head 14) detected by the second detector 320 (step S1505). In this example, the setting unit 340 selects the driving waveform pattern associated with the time information identical to the actual supply time t2 and the temperature information identical to the temperature detected by the second detector 320 among the driving waveform patterns contained in the correspondence information. Then, the setting unit 340 sets the selected driving waveform pattern as a new driving waveform pattern (step S1506). With this, the setting of the driving waveform pattern is changed and the controller 280 controls to finish the ink supply operation after step S1506.

On the other hand, if the setting unit 340 determines that the logical supply time t1 and the actual supply time t2 are identical (Yes at step S1504), the setting unit 340 does not change the driving waveform pattern (step S1507). Then, the setting unit 340 keeps setting of the current driving waveform pattern (previously set driving waveform pattern or default driving waveform pattern) (step S1508). After step S1508, the controller 280 controls to finish the ink supply operation.

As described above, in the embodiment, when the actual supply time t2 is different from the logical supply time t1, a new driving waveform pattern is set using the above-mentioned correspondence information, the actual supply time t2, and the temperature detected by the second detector 320. To be more specific, the driving waveform pattern associated with each of the time information identical to the actual supply time t2 and the temperature information identical to the temperature detected by the second detector 320 among the driving waveform patterns contained in the above-mentioned correspondence information is set as the new driving waveform pattern. This can achieve an advantageous effect that ink discharge control can be executed appropriately based on various ink characteristics.

First Modification of First Embodiment

The correspondence information in the above-mentioned first embodiment is information in which the driving waveform pattern and the predetermined temperature information in the recording head 14 are associated with each piece of predetermined time information. For example, the correspondence information may be information that does not contain the above-mentioned temperature information. For example, the correspondence information may be information in which the driving waveform pattern is associated with each of the pieces of predetermined time information. In this case, when the actual supply time t2 is different from the logical supply time t1, the setting unit 340 can also set, as a new driving waveform pattern, the driving waveform pattern associated with the time information corresponding to (for example, identical to) the actual supply time t2 among the driving waveform patterns contained in the correspondence information. When the ink characteristics change, the actual supply time t2 is also changed depending on the ink viscosity. The appropriate driving waveform pattern is selected based on the actual supply time t2, so that the ink discharge control can be appropriately executed based on the ink characteristics. As in the above-mentioned first embodiment, in the case where the driving waveform pattern is selected in consideration of the actual supply time t2 and the temperature in the recording head 14, the driving waveform pattern can be selected more appropriately based on the ink characteristics. This can achieve the advantageous effect that the ink discharge control can be executed more appropriately.

Second Modification of First Embodiment

Figure 18:
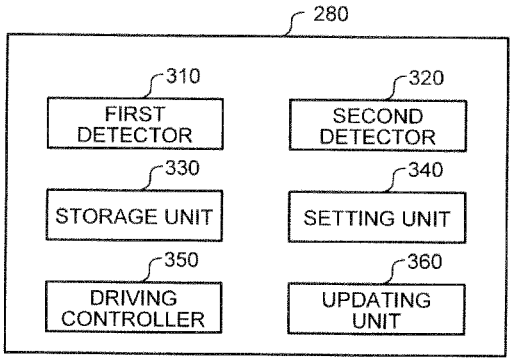
FIG. 18 is a block diagram illustrating an example of the functional configuration of a controller according to a modification of the first embodiment.

For example, the controller 280 may have a function of updating the correspondence information (in the following description, referred to as "existing correspondence information" in some cases) stored in the storage unit 330 based on new correspondence information received from the outside. FIG. 18 is a block diagram illustrating an example of the functional configuration of the controller 280 according to the second modification of the first embodiment. As illustrated in FIG. 18, the controller 280 further includes an updating unit 360. The updating unit 360 has a function of receiving correspondence information from an external server device or the like through the communication unit such as the host I/F 286 and updating the existing correspondence information based on the received correspondence information. To be more specific, the updating unit 360 updates the existing correspondence information when there is difference between the new correspondence information received from the outside and the existing correspondence information. For example, the whole existing correspondence information may be replaced by the correspondence information received from the outside or only the different part may be replaced.

Figure 19:
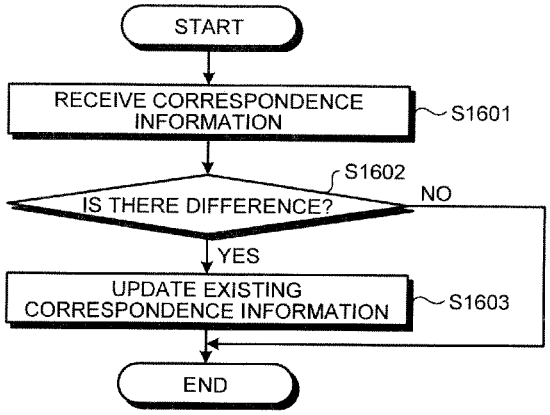
FIG. 19 is a flowchart illustrating an example of operation performed by an updating unit in the modification of the first embodiment.

FIG. 19 is a flowchart illustrating an example of operation performed by the updating unit 360 when new correspondence information is received from the outside. First, the updating unit 360 receives new correspondence information from an external server device or the like through the communication unit (step S1601). Then, the updating unit 360 compares the correspondence information received at step S1601 and the existing correspondence information and determines whether there is difference therebetween (step S1602). If there is the difference therebetween (Yes at step S1602), the updating unit 360 updates the existing correspondence information (step S1603). On the other hand, if there is no difference therebetween (No at step S1602), the updating unit 360 does not update the existing correspondence information and finishes the operation.

Second Embodiment

Next, a second embodiment is described. The apparatus configuration of the ink jet printer in the second embodiment is the same as that in the first embodiment but only the method of selecting the driving waveform pattern in the second embodiment is different from that in the first embodiment. Hereinafter, points different from the first embodiment are mainly described. In the following description, a controller in the second embodiment is referred to as a "controller 2800" while being distinguished from the controller 280 in the first embodiment.

Figures 20, 21:
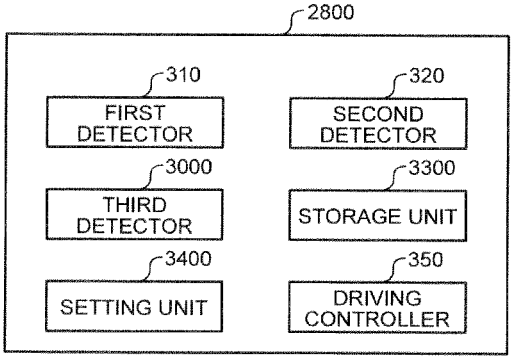
FIG. 20 is a block diagram illustrating an example of the functional configuration of a controller according to a second embodiment of the present invention.
FIG. 21 is a table illustrating an example of correspondence information in the second embodiment.

FIG. 20 is a block diagram illustrating an example of the functional configuration of the controller 2800. The functions of the first detector 310, the second detector 320, and the driving controller 350 are the same as those in the first embodiment and detail description thereof is omitted.

A third detector 3000 has a function of detecting an ink discharge amount. To be more specific, the third detector 3000 detects the ink discharge amount based on count values of the ink discharge counts (the number of times of discharge) through the respective nozzles of the recording head 14. The function can be achieved by well-known various techniques.

A storage unit 3300 stores therein correspondence information in which the above-mentioned driving waveform pattern and the temperature information indicating the predetermined temperature in the recording head 14 are associated with each piece of discharge amount information indicating the predetermined ink discharge amount. In the following description, the correspondence information stored in the storage unit 3300 is referred to as "second correspondence information" for distinguishing it from the correspondence information in the first embodiment in some cases. FIG. 21 is a table schematically illustrating an example of the second correspondence information. In the example of FIG. 21, the second correspondence information is information in which the driving waveform pattern, the temperature information, and the viscosity information are associated with each piece of discharge amount information.

A setting unit 3400 sets a new driving waveform pattern using the second correspondence information when an actual discharge amount is different from a discharge amount indicated by the discharge amount information associated with the current driving waveform pattern among the pieces of discharge amount information contained in the second correspondence information. The actual discharge amount indicates an ink discharge amount detected by the third detector 3000 from when the ink discharge is started until the first detector 310 detects that the ink remaining amount in each sub tank 15 is equal to or lower than the lower limit threshold. To be more specific, the setting unit 3400 sets a new driving waveform pattern using the second correspondence information, the actual discharge amount, and the temperature detected by the second detector 320. To be further more specific, the setting unit 3400 sets, as a new driving waveform pattern, a driving waveform pattern associated with the discharge amount information corresponding to (in this example, identical to) the actual discharge amount and the temperature information corresponding to (in this example, identical to) the temperature detected by the second detector 320 among the driving waveform patterns contained in the second correspondence information.

Figure 22:
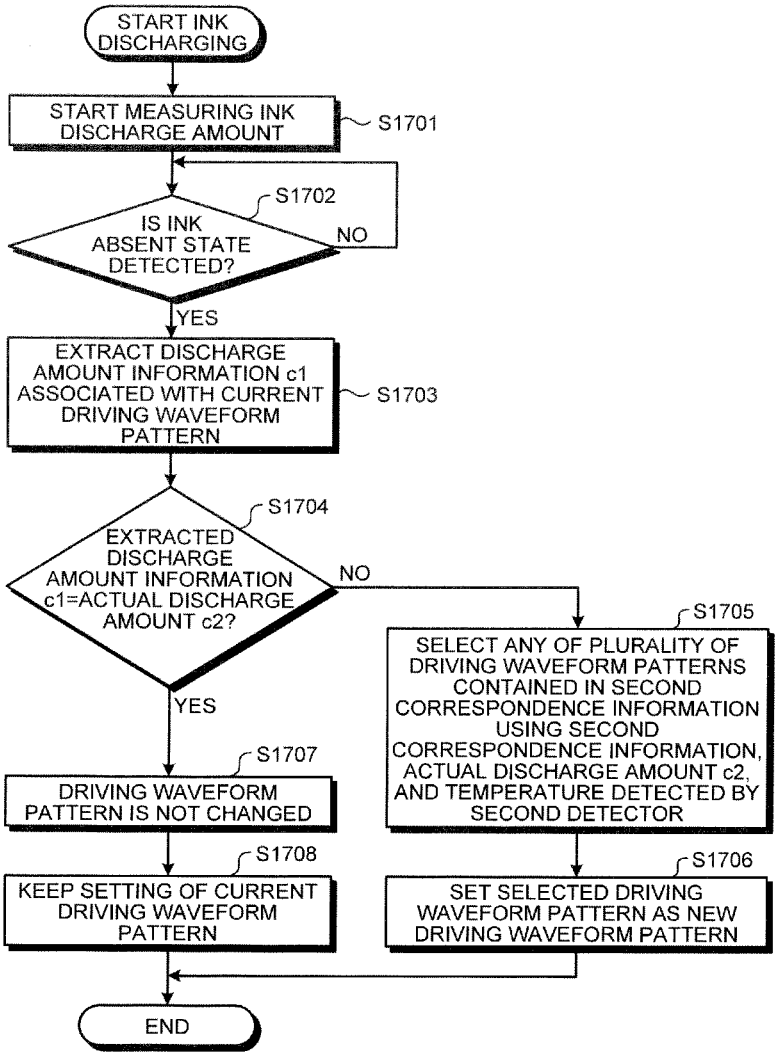
FIG. 22 is a flowchart illustrating an example of procedures of setting a driving waveform pattern at the time of ink discharging.

FIG. 22 is a flowchart illustrating an example of procedures of setting the driving waveform pattern at the time of the ink discharge. The driving waveform pattern at the start time of the ink discharge is assumed to be set to the previously selected driving waveform pattern. In an initial state where any driving waveform pattern is not yet selected, a driving waveform pattern (default driving waveform pattern) indicating an initial value is set.

First, the controller 280 controls to start measuring the ink discharge amount (step S1701). To be more specific, the third detector 3000 starts counting the number of times of ink discharge. For example, the third detector 3000 may measure a cumulative value of the ink discharge amounts based on three defined values of large droplets (36 pl), middle droplets (18 pl), and small droplets (2 pl). It should be noted that the defined values may be changed arbitrarily.

Subsequently, the first detector 310 detects whether the ink remaining amount in each sub tank 15 is equal to or lower than the lower limit threshold (whether the sub tank 15 is in the ink absent state) based on the detection signals from the detecting electrodes 141 and 142 (step S1702). If the first detector 310 detects that the ink remaining amount in the sub tank 15 is equal to or lower than the lower limit threshold (Yes at step S1702), the setting unit 3400 extracts discharge amount information c1 associated with the current driving waveform pattern among the pieces of discharge amount information contained in the second correspondence information (step S1703). In this case, the setting unit 3400 acquires, from the third detector 3000, an actual discharge amount c2 (in this example, ink discharge amount calculated based on the count cumulative value and the predetermined sizes of liquid droplets, that is, a total amount of the ink discharge amount detected actually) indicating the ink discharge amount detected by the third detector 3000 from when the ink discharge is started until the first detector 310 detects that the ink remaining amount in the sub tank 15 is equal to or lower than the lower limit threshold.

Subsequently, the setting unit 3400 compares the discharge amount information c1 extracted at step S1703 and the actual discharge amount c2 and determines whether the discharge amount indicated by the discharge amount information c1 is identical to the actual discharge amount c2 (step S1704). If the setting unit 3400 determines that the discharge amount indicated by the discharge amount information c1 is not identical to the actual discharge amount c2 (No at step S1704), the setting unit 3400 selects any one of the driving waveform patterns contained in the second correspondence information using the second correspondence information stored in the storage unit 3300, the actual discharge amount c2, and the temperature (temperature in the recording head 14) detected by the second detector 320 (step S1705). In this example, the setting unit 3400 selects the driving waveform pattern associated with each of the discharge amount information identical to the actual discharge amount c2 and the temperature information identical to the temperature detected by the second detector 320 among the driving waveform patterns contained in the second correspondence information. Then, the setting unit 3400 sets the selected driving waveform pattern as a new driving waveform pattern (step S1706). With this, the setting of the driving waveform pattern is changed.

On the other hand, if the setting unit 3400 determines that the discharge amount indicated by the discharge amount information c1 is identical to the actual discharge amount c2 (Yes at step S1704), the setting unit 3400 does not change the driving waveform pattern (step S1707). Then, the setting unit 3400 keeps setting of the current driving waveform pattern (previously set driving waveform pattern or default driving waveform pattern) (step S1708).

As described above, in the embodiment, when the above-mentioned actual discharge amount c2 is different from the discharge amount information c1 associated with the current driving waveform pattern among the pieces of discharge amount information contained in the second correspondence information, a new driving waveform pattern is set using the second correspondence information, the actual discharge amount c2, and the temperature detected by the second detector 320. To be more specific, the driving waveform pattern associated with each of the discharge amount information identical to the actual discharge amount c2 and the temperature information identical to the temperature detected by the second detector 320 among the driving waveform patterns contained in the second correspondence information is set as the new driving waveform pattern. This can achieve an advantageous effect that ink discharge control can be executed appropriately based on various ink characteristics.

First Modification of Second Embodiment

The above-mentioned second correspondence information is information in which the driving waveform pattern and the predetermined temperature information in the recording head 14 are associated with each piece of discharge amount information. For example, the second correspondence information may be information that does not contain the above-mentioned temperature information and in which the driving waveform pattern is associated with each piece of discharge amount information. In this case, when the actual discharge amount c2 is different from the discharge amount information c1 associated with the current driving waveform pattern among the pieces of discharge amount information contained in the second correspondence information, the setting unit 3400 can also set, as a new driving waveform pattern, the driving waveform pattern associated with the discharge amount information corresponding to (for example, identical to) the actual discharge amount c2 among the driving waveform patterns contained in the second correspondence information. When the ink characteristics change, the ink discharge amount that is detected actually is also changed based on the ink viscosity. The appropriate driving waveform pattern is selected based on the ink discharge amount (actual discharge amount c2) that is detected actually, so that the ink discharge control can be appropriately executed based on the ink characteristics. As in the above-mentioned second embodiment, in the case where the driving waveform pattern is selected in consideration of the actual discharge amount c2 and the temperature in the recording head 14, the driving waveform pattern can be selected more appropriately based on the ink characteristics. This can achieve the advantageous effect that the ink discharge control can be executed more appropriately.

Second Modification of Second Embodiment

Figure 23:
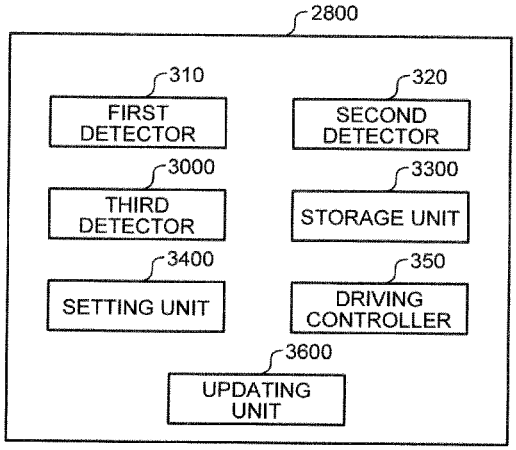
FIG. 23 is a block diagram illustrating an example of the functional configuration of a controller according to a modification of the second embodiment.

For example, the controller 2800 may have a function of updating the second correspondence information (in the following description, referred to as "existing second correspondence information" in some cases) stored in the storage unit 3300 based on new second correspondence information received from the outside. FIG. 23 is a block diagram illustrating an example of the functional configuration of the controller 2800 according to the second modification of the second embodiment. As illustrated in FIG. 23, the controller 2800 further includes an updating unit 3600. The updating unit 3600 has a function of receiving the second correspondence information from an external server device or the like through the communication unit such as the host I/F 286 and updating the existing second correspondence information based on the received second correspondence information. To be more specific, the updating unit 3600 updates the existing second correspondence information when there is difference between the new correspondence information received from the outside and the existing second correspondence information. For example, the whole existing second correspondence information may be replaced by the second correspondence information received from the outside or only the different part may be replaced.

Figure 24:
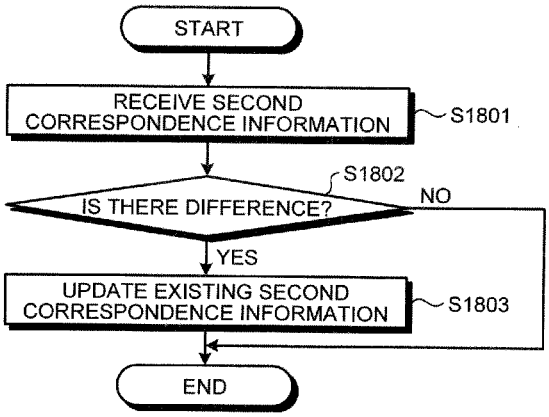
FIG. 24 is a flowchart illustrating an example of operation performed by an updating unit in the modification of the second embodiment.

FIG. 24 is a flowchart illustrating an example of operation performed by the updating unit 3600 when the new second correspondence information is received from the outside. First, the updating unit 3600 receives the new second correspondence information from an external server device or the like through the communication unit (step S1801). Then, the updating unit 3600 compares the second correspondence information received at step S1801 and the existing correspondence information and determines whether there is difference therebetween (step S1802). If there is the difference therebetween (Yes at step S1802), the updating unit 3600 updates the existing second correspondence information (step S1803). On the other hand, if there is no difference therebetween (No at step S1802), the updating unit 3600 does not update the existing second correspondence information and finishes the operation.

The programs to be executed by the above-mentioned controller (280, 2800) may be recorded and provided in a computer-readable recording medium such as a compact disc read only memory (CD-ROM), a flexible disk (FD), a compact disc recordable (CD-R), and a digital versatile disc (DVD), as an installable or executable file.

The programs to be executed by the above-mentioned controller (280 or 2800) may be stored in a computer connected to a network such as the Internet and provided by being downloaded via the network. Furthermore, the programs to be executed by the above-mentioned controller (280 or 2800) may be provided or distributed via a network such as the Internet.

The present invention enables the ink discharge control to be executed appropriately based on various ink characteristics.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An ink jet recording apparatus comprising:

a container to store therein ink;

a first detector to detect a remaining amount of the ink in the container;

a liquid feeding unit to supply the ink to the container;

an energy generation unit to cause the ink to be discharged;

a storage unit to store therein correspondence information in which driving information indicating information for driving the energy generation unit is associated with each piece of time information indicating a predetermined supply time taken to supply the ink; and a setting unit to set new driving information using the correspondence information when an actual supply time is different from the supply time indicated by the time information associated with current driving information among the pieces of time information contained in the correspondence information, the actual supply time indicating a time period from when the liquid feeding unit starts supplying the ink until the first detector detects that the remaining amount of the ink in the container is equal to or higher than a threshold.

2. The ink jet recording apparatus according to claim 1, wherein the setting unit sets, as the new driving information, the driving information associated with the time information corresponding to the actual supply time among a plurality of pieces of driving information contained in the correspondence information when the actual supply time is different from the supply time indicated by the time information associated with the current driving information among the pieces of time information contained in the correspondence information.

3. The ink jet recording apparatus according to claim 1, further comprising a second detector to detect a temperature in a recording head, the recording head including one or more liquid droplet discharging heads to discharge ink droplets using the energy generation unit, wherein the correspondence information is information in which the driving information and temperature information indicating a predetermined temperature in the recording heads are associated with each piece of time information, and the setting unit sets the new driving information using the correspondence information, the actual supply time, and the temperature detected by the second detector when the actual supply time is different from the supply time indicated by the time information associated with the current driving information among the pieces of time information contained in the correspondence information.

4. The ink jet recording apparatus according to claim 3, wherein the setting unit sets, as the new driving information, the driving information associated with the time information corresponding to the actual supply time and the temperature information corresponding to the temperature detected by the second detector among a plurality of pieces of driving information contained in the correspondence information when the actual supply time is different from the supply time indicated by the time information associated with the current driving information among the pieces of time information contained in the correspondence information.

5. The ink jet recording apparatus according to claim 1, further comprising an updating unit to update the correspondence information stored in the storage unit based on new correspondence information received from outside.

6. An ink jet recording apparatus comprising:

a container to store therein ink;

a first detector to detect a remaining amount of the ink in the container;

an energy generation unit to cause the ink to be discharged;

a third detector to detect a discharge amount of the ink;

a storage unit to store therein correspondence information in which driving information indicating information for driving the energy generation unit is associated with each piece of discharge amount information indicating a predetermined discharge amount of the ink; and a setting unit to set new driving information using the correspondence information when an actual discharge amount is different from a value indicated by the discharge amount information associated with current driving information among the pieces of discharge amount information contained in the correspondence information, the actual discharge amount indicating the discharge amount of the ink detected by the third detector from when ink discharge is started until the first detector detects that the remaining amount of the ink in the container is equal to or lower than a threshold, wherein the setting unit sets, as the new driving information, the driving information associated with the discharge amount information corresponding to the actual discharge amount among a plurality of pieces of driving information contained in the correspondence information when the actual discharge amount is different from the discharge amount indicated by the discharge amount information associated with the current driving information among the pieces of discharge amount information contained in the correspondence information.

7. The ink jet recording apparatus according to claim 6, further comprising a second detector to detect a temperature in a liquid droplet discharging head that includes the energy generation unit and discharges ink droplets, wherein the correspondence information is information in which the driving information and temperature information indicating a predetermined temperature are associated with each piece of discharge amount information, and the setting unit sets the new driving information using the correspondence information, the actual discharge amount, and the temperature detected by the second detector when the actual discharge amount is different from the discharge amount indicated by the discharge amount information associated with the current driving information among the pieces of discharge amount information contained in the correspondence information.

8. The ink jet recording apparatus according to claim 7, wherein the setting unit sets, as the new driving information, the driving information associated with the discharge amount information corresponding to the actual discharge amount and the temperature information corresponding to the temperature detected by the second detector among a plurality of pieces of driving information contained in the correspondence information when the actual discharge amount is different from the discharge amount indicated by the discharge amount information associated with the current driving information among the pieces of discharge amount information contained in the correspondence information.

9. The ink jet recording apparatus according to claim 6, further comprising an updating unit to update the correspondence information stored in the storage unit based on new correspondence information received from outside.

10. A control method comprising:

detecting a remaining amount of ink in a container that stores therein ink, and setting, using correspondence information in which driving information indicating information for driving an energy generation unit that causes the ink to be discharged is associated with each piece of time information indicating a predetermined supply time of the ink, new driving information when an actual supply time is different from a supply time indicated by the time information associated with current driving information among the pieces of time information contained in the correspondence information, the actual supply time indicating a time period from when ink supply to the container is started until it is detected that the remaining amount of the ink in the container is equal to or higher than a threshold.

* * * * *